United States Patent [19]

Inagaki

[11] Patent Number: 4,874,257

[45] Date of Patent: Oct. 17, 1989

[54] METHOD OF FORMING A CLOSED FILLED BAG, A BAG CONSTRUCTION AND AN APPARATUS FOR FORMING THE BAG

[75] Inventor: Hiromichi Inagaki, Aichi, Japan

[73] Assignee: Nihon Tokkyo Kanri Company Limited, Tokyo, Japan

[21] Appl. No.: 148,352

[22] Filed: Jan. 25, 1988

[30] Foreign Application Priority Data

| | | | |
|---|---|---|---|
| Jan. 27, 1987 | [JP] | Japan | 62-17738 |
| Jan. 28, 1987 | [JP] | Japan | 62-11027[U] |
| Jan. 29, 1987 | [JP] | Japan | 62-12404[U] |
| Mar. 17, 1987 | [JP] | Japan | 62-63305 |

[51] Int. Cl.[4] ..... B65D 33/16

[52] U.S. Cl. ..... 383/63; 383/95

[58] Field of Search ..... 383/63, 64, 65, 95, 383/97; 24/587, 588

[56] References Cited

U.S. PATENT DOCUMENTS

| | | | |
|---|---|---|---|
| 3,462,068 | 8/1969 | Suominen | 383/63 X |
| 3,780,781 | 12/1973 | Uramoto | 383/65 X |
| 3,991,801 | 11/1976 | Ausnit | 383/65 X |
| 4,657,792 | 4/1987 | Ausnit | 383/63 X |

*Primary Examiner*—Stephen Marcus

*Assistant Examiner*—Nova Stucker

*Attorney, Agent, or Firm*—McGlew & Tuttle

[57] ABSTRACT

A closed filled bag is formed using a cylindrical mandrel by feeding a bag forming sheet of a heat-sealable film which is of a web and is directed in a manner to one side of the mandrel so that it leaves two marginal edges on the opposite side of the mandrel which are guided into abutting relationship while the body thereof is formed into a cylinder around the mandrel. The zipper tape is fed to the mandrel and it is provided with spaced apart zipper elements which during feeding are folded into juxtaposition so that a U-shaped zipper tape is fed to the mandrel to overlie the two marginal edges which are of the bag forming sheet and the zipper tape has marginal edges below the zipper elements which are secured to the marginal edges of the bag forming sheet. During the forming of the bag forming sheet on the mandrel the product which is to be inserted in the package which will result is directed through the top of the mandrel and the sheet as it exits from the mandrel is sealed along its bottom as the bag forming sheet is fed further away from the mandrel a second seal is made across the top which encloses the material within the package. The sealing is advantageously made to extend through the zipper tape at both the top and bottom also.

5 Claims, 12 Drawing Sheets

METHOD OF FORMING A CLOSED FILLED BAG, A BAG CONSTRUCTION AND AN APPARATUS FOR FORMING THE BAG

FIELD AND BACKGROUND OF THE INVENTION

This invention relates in general to bag and package construction and in particular to a new and useful package and to a method of forming and filling the package and to an apparatus for carrying out the method.

It is known to provide bags which have a zipper inside the bag so that the bag opening may be turned to a closed condition. As shown in FIG. 1 of the present application such a bag includes a zipper tape 01 made of a heat sealable film formed into a convex strip 02 inside an opening or port 06 of a bag body 05. The zipper tape 01 comprises a male element 02 which is engageable in a socket or female element 04 of another tape 03 which is placed on an opposite bag panel. In such a bag the tape element 01 and 03 are heat sealed separately to the associated bag body 05. A difficulty with such bags is that the tape strips containing the various interengageable elements for sealing the bag are not easy to align and it is difficult to close the bag without causing wrinkles in the bag body. Also because the bag is fabricated while the zipper elements are engaged together it was impossible to fill or maintain the filling of the bag contents or products at the same time. Such a bag was fabricated with the zipper and then the zipper would have to be opened before the product could be put into the bag. As a result of this disadvantage such a bag was not used because of its high cost in mass production and its difficulty in use with manufacturing elements which also fill the contents into the bag.

SUMMARY OF THE INVENTION

In accordance with the invention a bag is formed which includes the bag body having a U-shaped form with lined and marginal edges which may be joined through a separate sheet containing zipper elements which during fabrication are folded together to interengage the zipper elements and then is joined to the marginal edges of the folded bag body sheet. With such an arrangement the bag may be formed around a cylindrical mandrel which may be filled at the same time the bag element is being formed and joined to the separate sheet containing the zipper elements. The product may be placed within the bag which is formed into a cylinder around the mandrel and the sealing may be carried out as soon as the bag is filed to complete a sealed filled package having a zipper portion conformed therewith which may be used to reclose the bag after it has been opened for use.

Accordingly an object of the invention is to provide an improved bag construction in which a bag body is made by folding a sheet around a mandrel and which body includes adjacent marginal edges which are sealed to a zipper strip which is formed into a U-shape so that the zipper elements are interengaged.

A further object of the invention is to provide a method of forming and filling a bag using a cylindrical mandrel in which a bag forming sheet of heat sealable film is fed around a cylindrical mandrel so that it leaves two marginal edges on the opposite side thereof which are guided into abutting relationship while a zipper tape is also fed to the mandrel which has spaced apart zipper elements and folded as it is fed so that the zipper elements interengage leaving marginal edges which are joined to the marginal edges of the bag forming sheet and wherein the bag may be heat sealed as it leaves the mandrel and as the filling through the mandrel is taking place and thereafter the bag is closed and by heat sealing after it is fed away from the mandrel.

A further object of the invention is to provide an apparatus for forming and filling a bag which includes the cylindrical mandrel and the feeding system for both the bag forming film and the zipper film so that these may be joined as the filling progresses.

A further object of the invention is to provide a bag construction and an apparatus for forming a bag which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
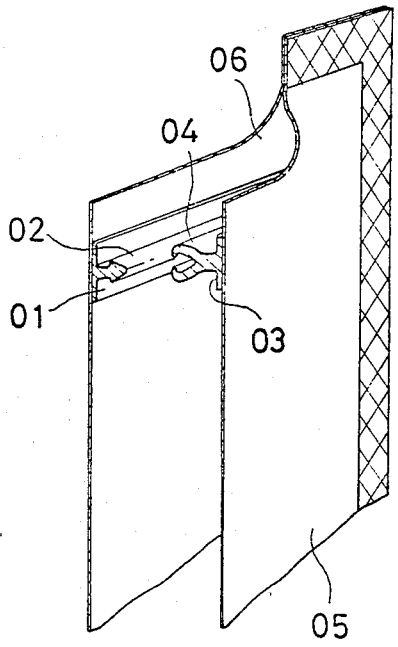
FIG. 1 is a partial top perspective view of a bag constructed in accordance with the prior art.
Figure 2:
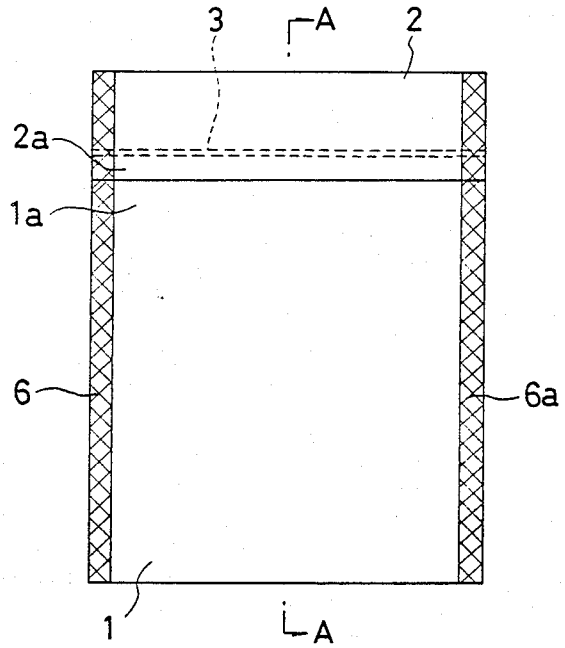
FIG. 2 is a plan view of a sealed and filled package constructed in accordance with the invention.
Figure 3:
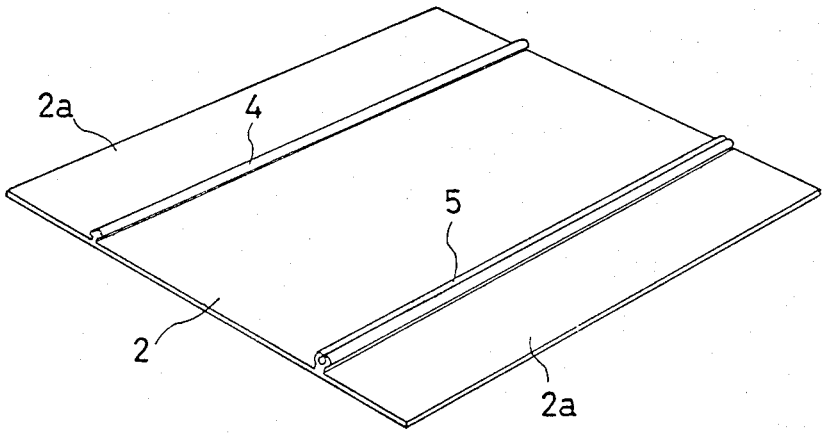
FIG. 3 is a top perspective view of a zipper tape for the package shown in FIG. 2 shown on a larger scale.

Referring to the drawings in particular the prior art type of bag is shown in FIG. 1.

Figure 4:
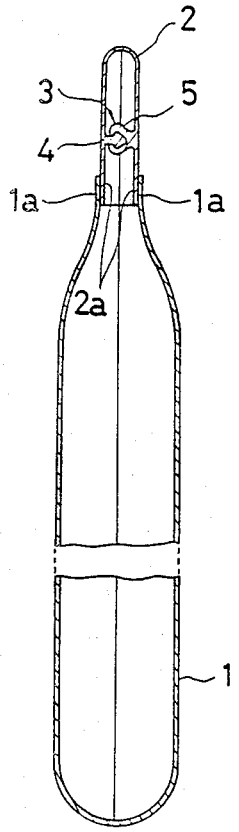
FIG. 4 is a sectional view of a bag or package constructed in accordance with the invention.
Figure 5:
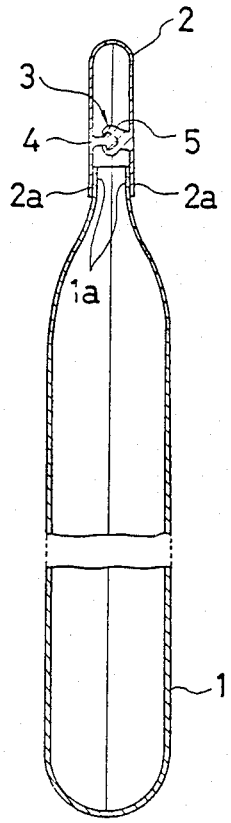
FIG. 5 is a view similar to FIG. 4 of another embodiment of the invention.
Figure 6:
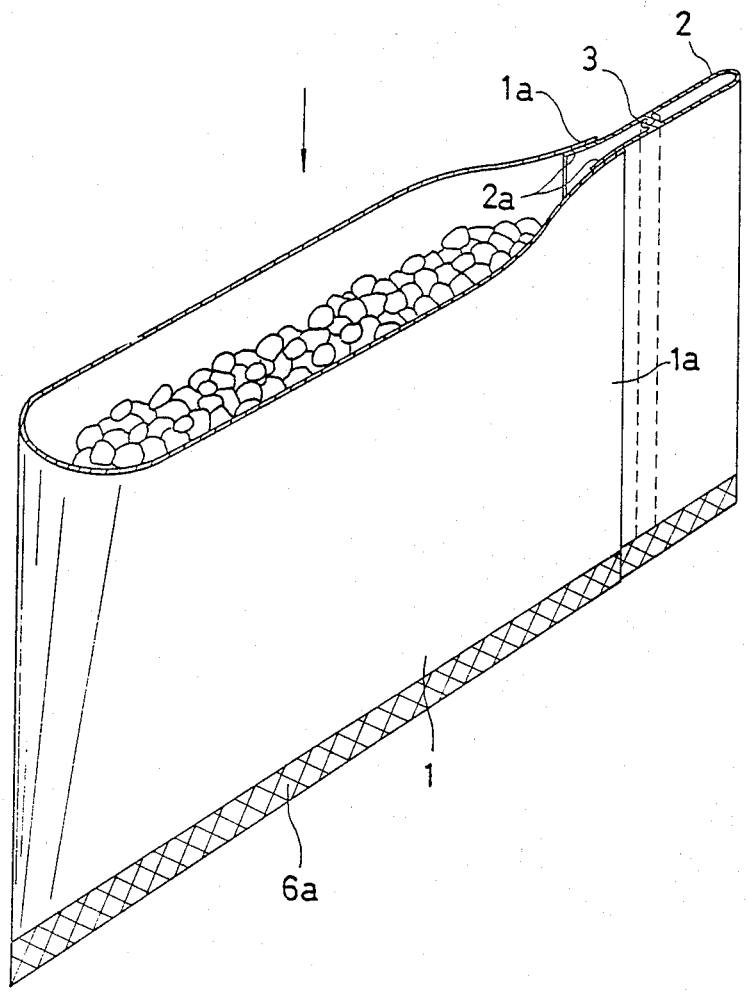
FIG. 6 is a front top perspective view of a package constructed in accordance with the invention.

The invention is covered by FIGS. 2 to 20 and it includes the bag construction as best shown in FIGS. 4 and 5 which comprises the U-shaped sheet 1 having overlying adjacent first sealing ends 1*a*, 1*a* forming a pair of opposite ends which are heat sealable to close the bags as best shown for example in FIG. 6 by the heat sealing application 6*a*. The U-shaped sheet 1 forms a bag body together with a U-shaped zipper taped strip 2 having opposed panel portions with marginal edges or brims 2*a*. Each panel portion has a zipper strip portion 4 or 5 which interengage as indicated at 3. The interengaement is produced by a projection or male member 4 entering into a receptacle or socket 5 on the other. Panel portions of the bag body 1 have respective opposite ends which are heat sealed such as indicated at 6*a* in FIG. 6 and are also shown in FIGS. 16 and 19 at the respective opposite edges.

As shown in FIGS. 4 and 5 the zipper strip 2 may be secured so that its marginal edges 2*a* extend inside of the marginal edges 1*a* of the bag body 1 or it may be secured so that they extend outside of the bag body 1 as shown in FIG. 5.

Figure 7:
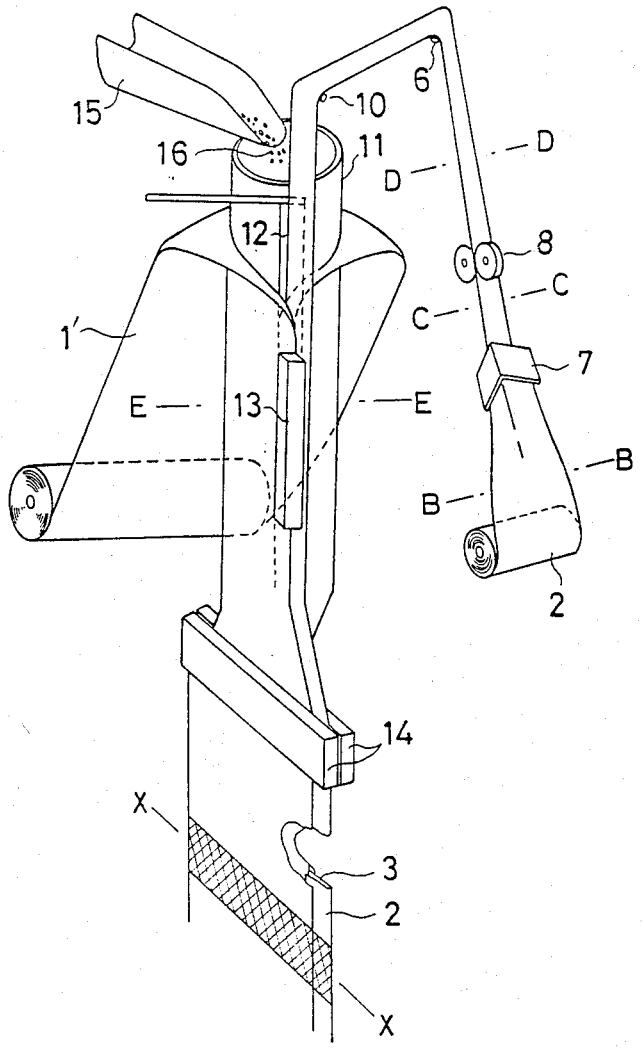
FIG. 7 is a front top schematic perspective view of a bag forming, filling and packaging apparatus constructed in accordance with the invention.
Figure 8:
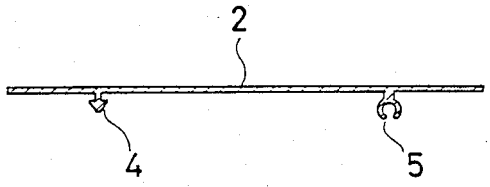
FIG. 8 is a sectional view of a zipper strip of the invention.
Figure 9:
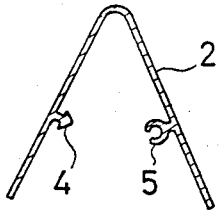
FIG. 9 is a view of the zipper strip shown in a partly folded position.
Figure 10:
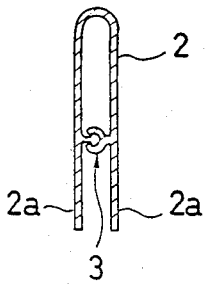
FIG. 10 is a sectional view of the zipper strip shown in a completely folded position ready for joining to the bag forming sheet.
Figure 11:
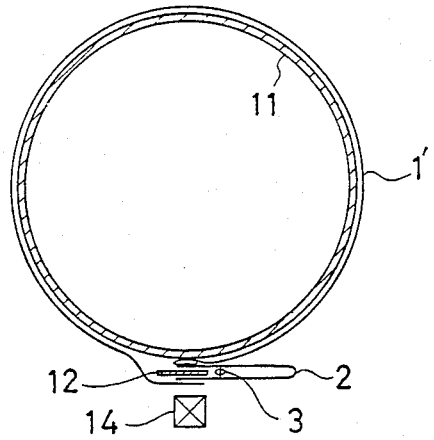
FIG. 11 is a horizontal sectional view of the bag forming filling and packaging machine mandrel.
Figure 12:
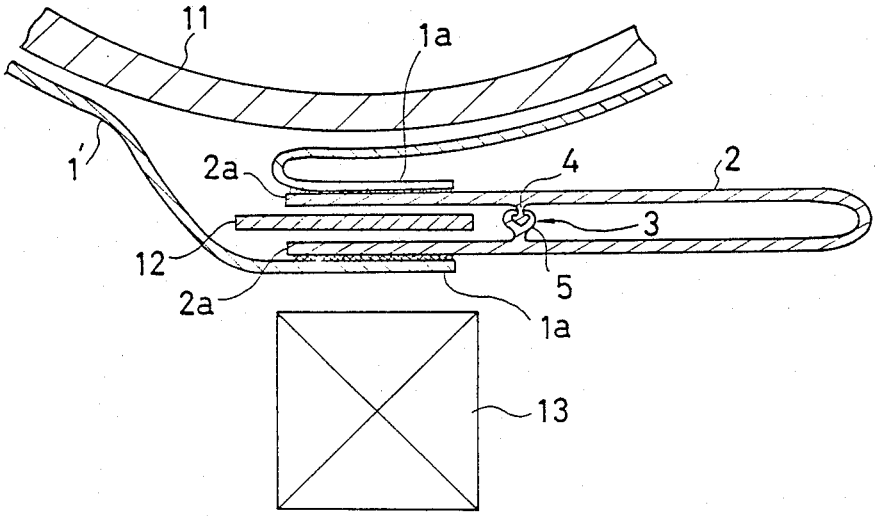
FIG. 12 is a partial sectional view of the bag forming filling and packaging machine of FIG. 7.
Figure 13:
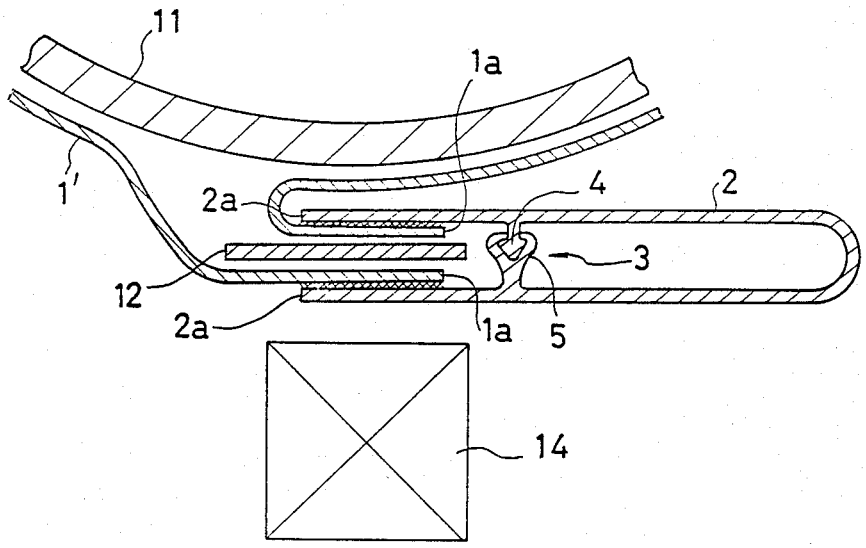
FIG. 13 is a view similar to FIG. 12 showing the joining of the zipper strip at a bag closing and heat sealing station.

As shown in FIG. 7, a method of forming a closed filled bag and/or package is carried out with apparatus which includes a cylindrical mandrel 11 around which a heat sealable film such as a polyester tape 1′ is fed from a roll so as to engage around the mandrel and leave marginal edges on the opposite side which are guided into abutting relationship. A zipper strip 2 is fed from a supply of the strip which already includes zipper elements 4 and 5 on panel portions which are folded by a folder 7 from the shape indicated in FIG. 8 to the shape indicated in FIGS. 9 and 10 until the marginal edges 2*a*, 2*a* thereof are brought into alignment with the marginal edges 1*a*, 1*a* of the bag forming sheet 1 around the mandrel 11. The edges 1*a* and 2*a* after sealing close the cylinder and permit the filling of the bag with a product 16 from a chute 15 which empties into the mandrel 11. This filling is carried out after the zipper strip 2 is fed past guide rollers 8, 6 and 10 and is engaged with and sealed to the edges of the bag forming film 1′ and the bottom seal is effected by bottom sealing elements 14. The feeding of the bag forming sheet 1′ and a zipper sheet 2 is fed around a central member which does not stick to the sheet such as a teflon material 12. As shown in the drawings the sealing is carried out by sealing members 14 as shown in FIGS. 11 and 13. Previous heat sealing is effected by the heat sealing element 13 to join the zipper strip 2 to the bag forming sheet 1′.

Figure 14:
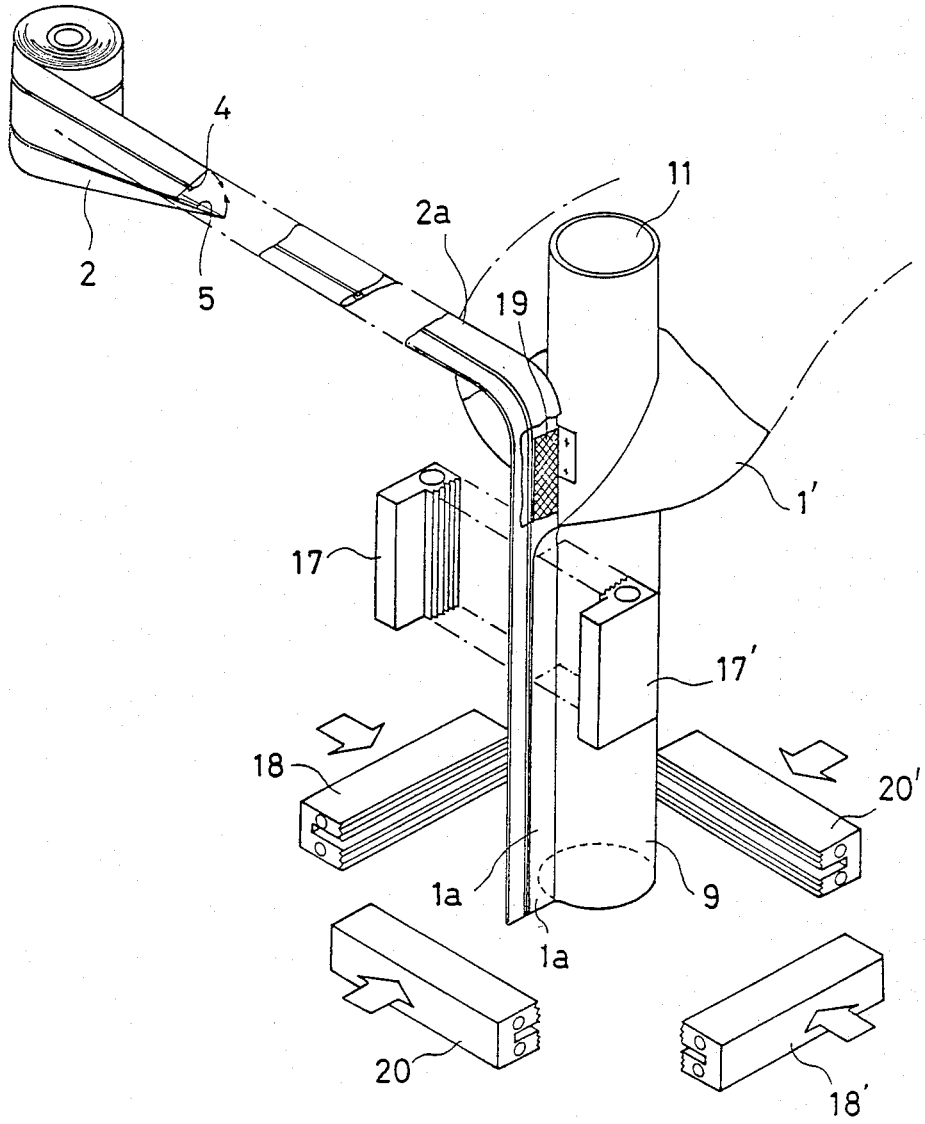
FIG. 14 is a view similar to FIG. 7 of another embodiment of the invention.

In the embodiment of the invention shown in FIG. 14, the zipper tape 2 is attached to the inside of the opening port and in this fabrication method the bag body 1′ is not only bent around the cylindrical mandrel 11 but also the upper edges 1*a*, 1*a* are joined together. The heat sealing bar 17 and 17′ engage the lower ends 2*a*, 2*a* from each side so as to heat seal it to the upper end 1*a* of the bag body tape 1′. In this construction the heat insulator 19 such as a teflon sheet is inserted into the middle and prevents the edges of the zipper tape 2 from being sealed together.

Heat sealing at a right angle direction from the previous heat sealing may take place by the heat sealing bars 20 and 20′. At this location the heat insulator member is not in alignment therewith so that heat sealing of the inner layers of the zipper tape 2 in the bag body 1, for instance, can take place. The product is then put into the bag through the interior of the mandrel 11 and the feeding of the tape stops after its movement by one bag portion. The horizontal heat seal bars 20 and 20′ are again heated to perform a sealing operation. As a result the content which has previously been thrown into the bag is completely sealed inside the bag. The bags which have been sealed in this way are then cut into each bag portion at the next station.

The heat seal bars 17 and 17′ and the heat seal bars 18 and 18′ and bars 20 and 20′ in the cutter are actuated in synchronization, and in the meantime the bag side remains at a standstill.

Figure 15:
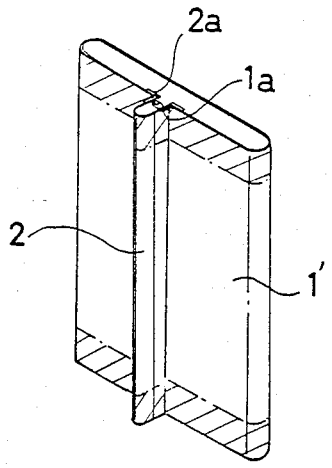
FIG. 15 is a top perspective view indicating the joining of the zipper strip to the bag forming body.
Figure 16:
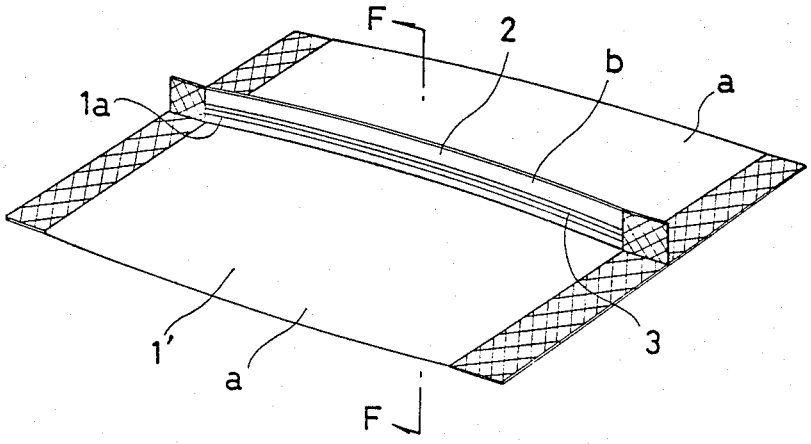
FIG. 16 is a top perspective view of the package formed in accordance with the invention.
Figure 17:
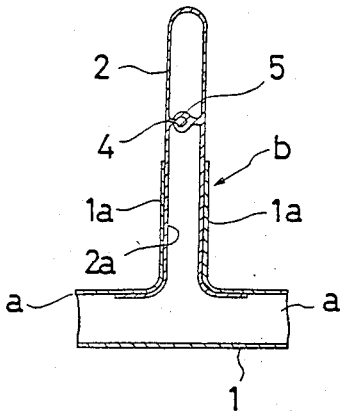
FIG. 17 is a section taken along the line F—F of FIG. 16.

FIG. 15 shows the heat sealed position in a cylindrical body 9, wherein the shaded areas are heat sealed by the horizontal heat seal bars 20 and 20′. FIG. 16 illustrates the construction in which the bag is formed by this heat sealing and this bag presents an inverted T-shape including a wing a and a neck b and is positioned inside neck b as shown in FIG. 17.

Figure 18:
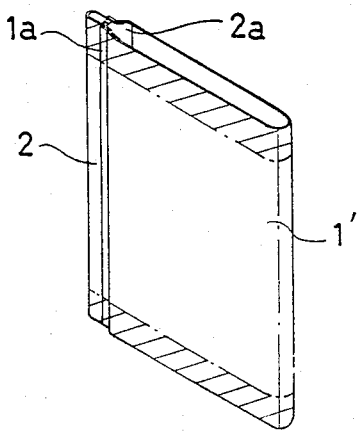
FIG. 18 is a view similar to FIG. 15 showing another embodiment of the bag.
Figure 19:
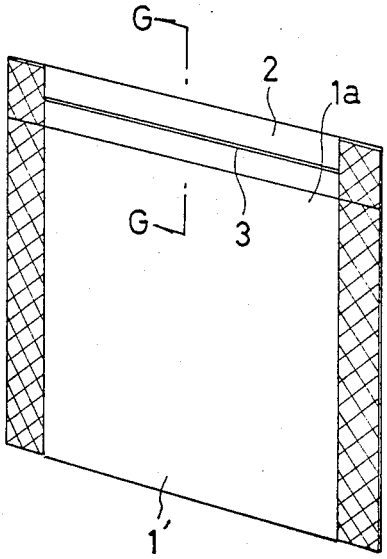
FIG. 19 is a view similar to FIG. 16 of another embodiment of the bag.
Figure 20:
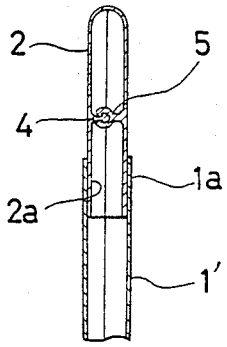
FIG. 20 is a section taken along the line G—G of FIG. 19.

In FIG. 18, the pattern of a bag formed in the event that the positions for horizontal heat seal bars 18 and 18′ have been changed 90°. That is in the case of FIG. 14 the side zipper tape 2 is directed to the front with the horizontal heat seal bars 18 and 18′ being pressed against it from the right and left sides and the cylindrical bag body tape 1′ is put between them and heat sealed in this state. The bag is heat sealed in the shaded area in FIG. 18 by the horizontal heat seal bars 18 and 18′ so as to form a bag as illustrated in FIG. 19. The sectional area in the portion of this opening port is as shown in FIG. 20 which is identical to the bag that is shown in FIG. 1.

With the invention there is no need to perform a bag making operation independently of the filling operation. In addition the bag making and the filling equipment can be fabricated quite easily at a relatively low cost.

While specific emboiments of the invention have been shown and described in detail to illustrate the application of the principles of the invention, it will be understood that the invention may be embodied otherwise without departing from such principles.

What is claimed is:

1. A bag construction, comprising a plastic seamless sheet having an U-shaped portion with sealing edges and a first and second pair of opposed ends which are sealable to cooperate with the U-shaped portion to define a bag body, a tap strip having opposed brim portions each having a zipper strip portion with a projection on one and a receiving socket on the other which are interengageable and hold said brim portions to form a tape strip U-shaped portion, said brim portions having marginal edges on sides of the respective zipper strip portions remote from said tape strip U-shaped portion, said marginal edges being sealed to said sealing edges of said bag body with said sheet U-shaped portion facing said tape strip U-shaped portion in opposed relationship.

2. A bag construction according to claim 1 including a heat sealing extending across said bag body at respective ends thereof and which are at right angles to said first sealing ends.

3. A bag construction comprising a seamless plastic sheet positioned to form a sheet U-shaped portion and free, extending, sealing edges, first and second opposite ends extending transversely between the U-shaped portion and the free edges, a tape strip with opposed brim portions having respective zipper strip portions of complementary, interengageable shape said zipper strip portions being engaged to form a tape strip U-shaped portion with tape strip brim portions having marginal edges, said marginal edges being, sealed to said extending sealing edges as said sheet U-shaped portion and said tape strip U-shaped portion, with engaged zipper strip portion, are in an opposed relationship.

4. A bag precursor comprising seamless sheet having one end extending from a supply reel and folded about an axis adjacent an opposite, end into a U-shaped portion of a bag body with free extending sealing edges and having a transversely extending, open, upper filling end and a transversely extending, lower end, heat sealed closed; a filling in said bag body; a tape strip having one end extending from a supply reel, brim portions extending in substantially parallel relation along the tape strip, said brim portions having respective zipper portions of complementary interengageable shape, the tape strip being folded about an axis adjacent an opposite end with the zipper strip portions being engaged thereby holding the brim portions together to form a tape strip U-shaped portion, said brim portions with engaged zipper strip portions having extending marginal edges sealed to said first sealing edges as said tape strip U-shaped portion and said bag body U-shaped portion are in opposed relationship.

5. A bag precursor according to claim 4 wherein the marginal edges of respective brim portions are located on sides of the respective zipper strip portions remote from the fold.

* * * * *